US012203262B1

(12) United States Patent
Boor

(10) Patent No.: US 12,203,262 B1
(45) Date of Patent: Jan. 21, 2025

(54) FLOATING PURLIN HANGER

(71) Applicant: Lester Building Systems, LLC., Lester Prairie, MN (US)

(72) Inventor: Paul A. Boor, Hutchinson, MN (US)

(73) Assignee: Lester Building Systems, LLC, Lester Prairie, MN (US)

( * ) Notice: Subject to any disclaimer, the term of this patent is extended or adjusted under 35 U.S.C. 154(b) by 0 days.

(21) Appl. No.: 17/074,361

(22) Filed: Oct. 19, 2020

Related U.S. Application Data

(60) Provisional application No. 62/916,573, filed on Oct. 17, 2019.

(51) Int. Cl.
*E04B 1/38* (2006.01)
*E04B 7/02* (2006.01)

(52) U.S. Cl.
CPC ..... *E04B 1/388* (2023.08); *E04B 7/024* (2013.01); *E04B 2001/389* (2023.08)

(58) Field of Classification Search
CPC ..... E04B 1/40; E04B 7/024; E04B 2001/405
USPC ..... 52/702
See application file for complete search history.

(56) References Cited

U.S. PATENT DOCUMENTS 3,423,898 A * 1/1969 Coloney ..... E04B 7/063 52/713
4,449,335 A * 5/1984 Fahey ..... E04B 1/2608 52/713
4,498,801 A * 2/1985 Gilb ..... F16B 9/058 403/232.1
5,104,252 A * 4/1992 Colonias ..... F16B 9/058 403/232.1
5,555,694 A * 9/1996 Commins ..... E04B 1/2612 52/702
6,837,019 B2 * 1/2005 Collie ..... E04B 7/045 52/489.1
6,931,813 B2 * 8/2005 Collie ..... E04B 7/045 52/702
7,237,368 B2 * 7/2007 Richardson ..... E04B 1/4107 52/295
8,590,223 B2 * 11/2013 Kilgore ..... H02S 20/24 52/173.3
8,894,424 B2 * 11/2014 DuPont ..... F24S 25/12 439/95
9,003,738 B1 * 4/2015 Evans, Jr. ..... E04B 1/2604 52/702
10,358,811 B1 * 7/2019 Fox ..... E04B 1/2604
10,358,812 B2 * 7/2019 Jensen ..... E04B 1/2612
11,118,727 B2 * 9/2021 McKechnie ..... F16M 13/02
2001/0004099 A1 * 6/2001 Onishi ..... F16B 37/045 248/49
2004/0163355 A1 * 8/2004 Collie ..... E04B 7/045 52/702
2005/0019096 A1 * 1/2005 Prange ..... H02G 3/0608 403/231
2005/0226683 A1 * 10/2005 Herb ..... E04B 9/18 403/230

(Continued)

*Primary Examiner* — James J Buckle, Jr.
(74) *Attorney, Agent, or Firm* — Glen E. Schumann; Moss & Barnett

(57) ABSTRACT

The present invention relates to a roof mounting system for roof structures having purlins supported on roof trusses, the roof mounting system including a purlin hanger having at least one purlin support and mounting bracket for securing the purlin hanger to a truss in sliding relation.

9 Claims, 11 Drawing Sheets

(56) References Cited

U.S. PATENT DOCUMENTS

| | | | | |
|---|---|---|---|---|
| 2014/0182236 | A1* | 7/2014 | Doupe | E04F 15/02044 52/698 |
| 2016/0002912 | A1* | 1/2016 | Doupe | E04B 1/2604 52/702 |

* cited by examiner

FLOATING PURLIN HANGER

REFERENCE TO RELATED APPLICATION

This application claims priority to U.S. Applic. No. 62/916,573 which was filed on Oct. 17, 2019. The contents of which are incorporated herein by reference.

FIELD OF THE INVENTION

The invention relates generally to an improved roof system. More specifically, the invention relates to a sliding or "floating" purlin hanger which allows movement of roof cladding with respect to the roof trusses caused by thermal effects.

BACKGROUND OF THE INVENTION

Post frame buildings are some of the lowest cost structures that can be produced. The through fastened corrugated steel cladding is one of the primary reasons. This cladding serves as structural sheathing, drainage plane, and building finish. It is also a major element of the building's global stability system. The ability of through fastened, corrugated steel cladding to fulfill all these functions has caused this system to become deeply engrained into the fabric of post frame construction.

Steel, like most materials, expands and contracts as it warms and cools. Metals in particular tend to have large coefficients of thermal expansion. Thermal expansion occurs in all directions. Raise the temperature of a metal cladding panel and the cladding grows in three directions, very slightly increasing the cladding thickness. Panel width increases measurably. Long panels and large changes in temperature will cause panel length to change more than an inch in many installations.

Cladding panels have corrugations rolled into the panel. When the width of the panel changes due to thermal effects, the corrugations can easily accommodate via slight changes in the panel cross section. The change in panel length, however, is too large to ignore. Panels are quite rigid parallel to the panel ribs and cannot readily change shape.

Even so, this thermal movement has little impact when buildings are small in size and panels are less than 20' in length. The wood framing absorbs the small length changes without developing large resisting forces.

While the use of short panels and thermal splices is effective in mitigating the effects of thermal movement, customers and builders are pushing in the other direction. Customers like the aesthetics and supposed increased resistance to leaks that result from long panels. Builders want to avoid the time, material, and fuss required to install an effective thermal splice. But as buildings get larger and the panels used to sheath them get longer, the framing can no longer absorb this motion. The structure can literally tear itself apart as the cladding and framing push in opposite directions. The market is demanding another solution.

SUMMARY OF THE INVENTION

The present invention utilizes a device to slidably secure purlins between the roof trusses. The roof cladding is secured to the purlins. Thermal effects on the cladding cause the purlins to slide with respect to the roof trusses. Allowing movement at low force levels prevents damage to the cladding or roof structure even when long panels are used.

BRIEF DESCRIPTION OF THE DRAWINGS

The accompanying drawings are included to provide a further understanding of embodiments, are incorporated in, and constitute a part of this specification. The drawings illustrate embodiments and together with the description serve to explain the principles of the embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

The sliding purlin hanger of the present invention is a device that allows the management of thermal movement of metallic through fastened building panels. It allows a roof purlin to move with roof steel cladding (panels) at force levels far below those that could damage the building, because the steel cladding is isolated from the building frame/trusses. The cladding panels are secured to purlins which in turn are secured to purlin hangers that are slidably mounted on the roof trusses. This allows the cladding to "float" on the sliding purlin hangers mounted to the roof trusses.

Assume a Cartesian coordinate system with the X-axis parallel to the long axis of the purlin, the Y-axis perpendicular to the purlin and parallel to the roof slope, and the Z-axis perpendicular to plane X-Y. The standard purlin to primary connection prevents all six modes of 3-D movement. (X, Y, and Z translation and rotation about the X, Y, and Z axis.) The sliding purlin hanger of the present invention prevents five modes of movement but allows translation along the Y-axis.

The present invention anticipates many orientations of the sliding purlin hanger. A few embodiments are described herein for illustrative purposes, but these embodiments should not be viewed as limiting the possibilities evident from this disclosure.

Figure 1:
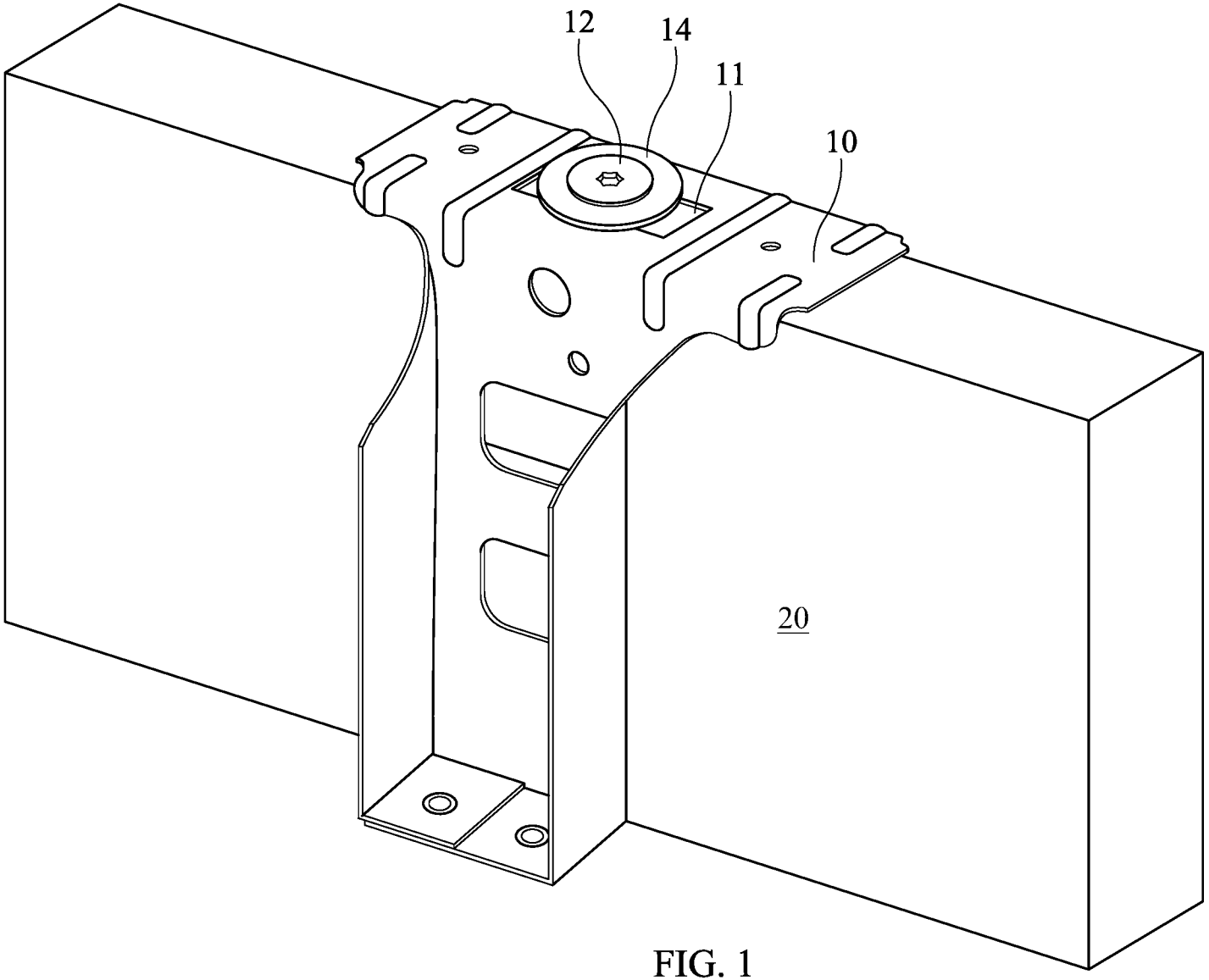
FIG. 1 is a perspective view of a first embodiment of the present invention, including a sliding purlin hanger slidably mounted on a roof truss.
Figure 2:
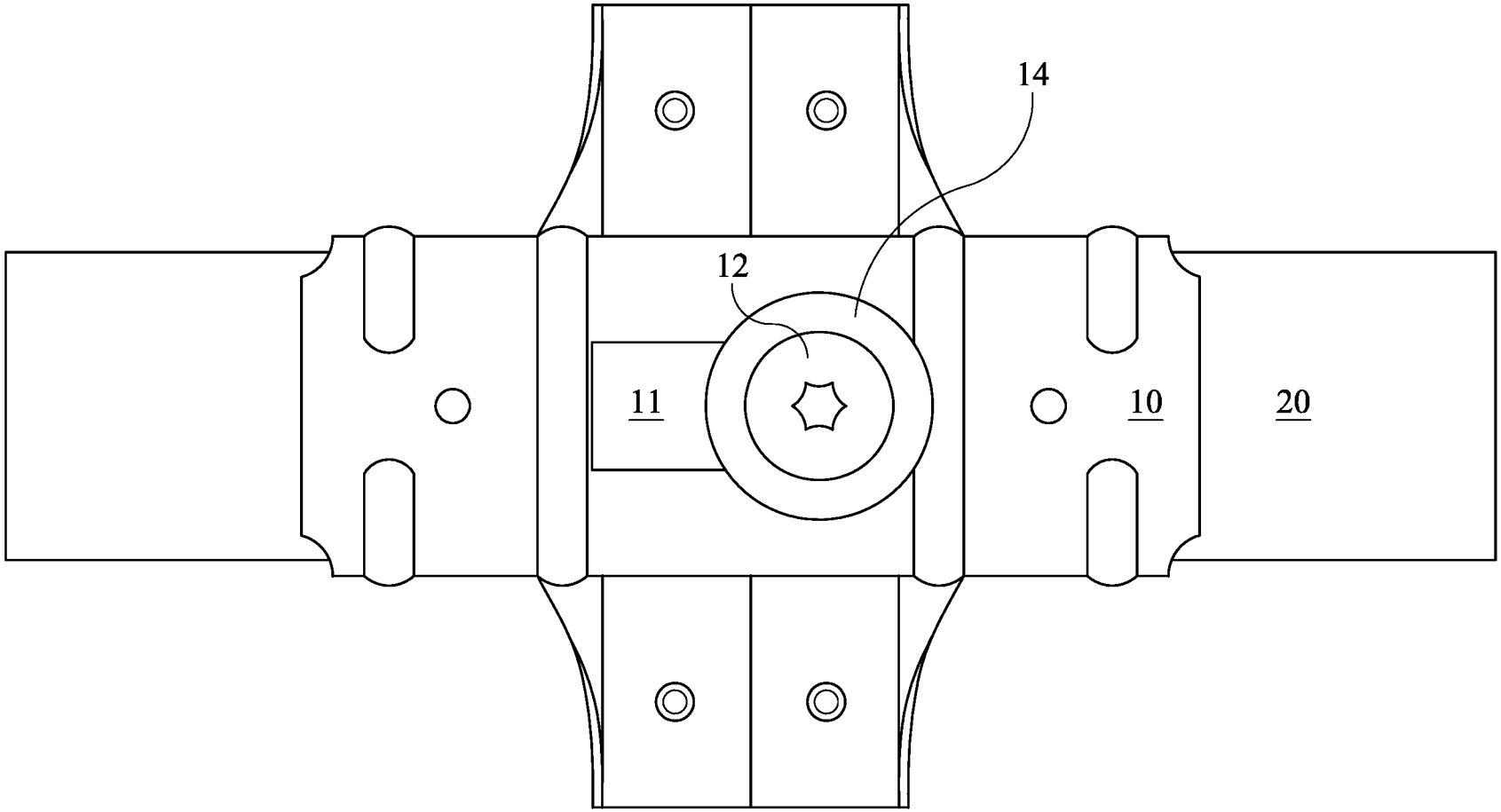
FIG. 2 is a top view of the sliding purlin hanger of FIG. 1.
Figure 5A:
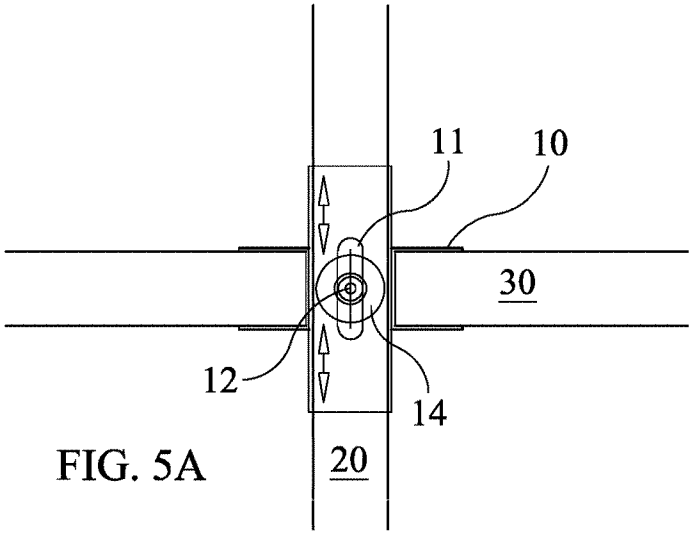
FIG. 5A is a top view of the first embodiment of a slotted purlin hanger with screw hold down with the hanger mounted on a truss, supporting a purlin on each side.
Figure 5B:
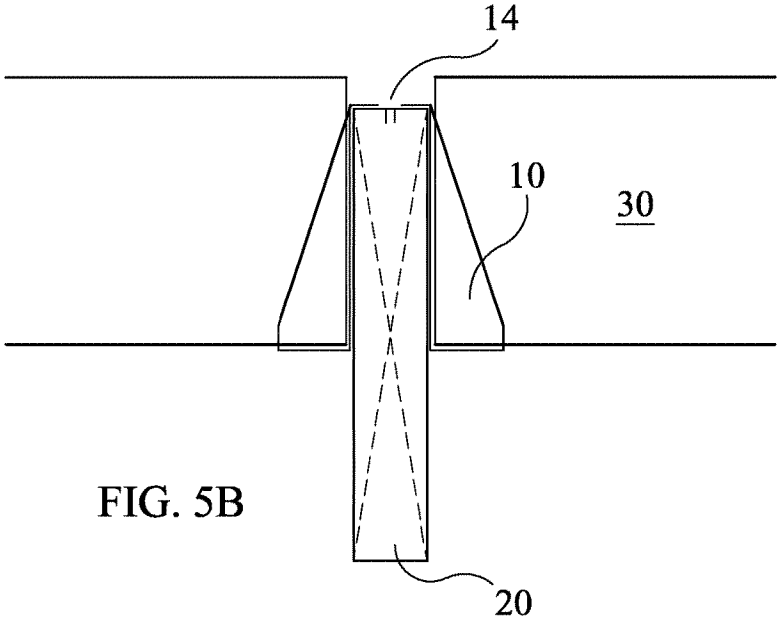
FIG. 5B is a front view of the first embodiment of a slotted purlin hanger with screw hold down with the hanger mounted on a truss, supporting a purlin on each side.
Figure 5C:
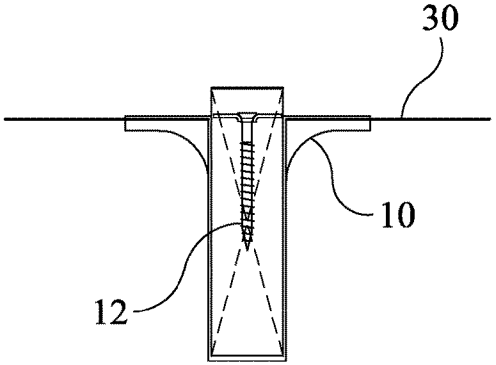
FIG. 5C is a partial side view of the first embodiment of a slotted purlin hanger with screw hold down with the hanger mounted on a truss, supporting a purlin on each side.

One embodiment of the present invention is shown in FIGS. 1, 2 and 5. The sliding saddle hanger 10 of the present invention is shown mounted on a truss 20. Defined at the top of the sliding saddle hanger 10 is a slot 11. As illustrated in FIGS. 1 and 2, the slot has a width and a length wherein the slot width is smaller than the slot length. The hanger 10 is secured to the truss 20 by a screw 12. A large hold down washer 14 is utilized to secure the saddle hanger 10 in sliding relation to the truss 20. A small washer (not shown) is positioned on the screw 12, below the large hold down washer 14, and rests within the slot 11. In one embodiment, the small washer is slightly thicker than the thickness of the sliding saddle hanger 10 around the slot 11, acting as a shim to prevent the hold down washer 14 from tightening against the sliding saddle hanger 10, to ensure the sliding saddle hanger 10 can slide along the truss 20. The sliding saddle hanger 10 supports purlins 30(FIGS. 5A and 5B) on each side of the sliding saddle hanger 10 and can move freely until a slot 11 edge engages the screw 12.

Figure 3:
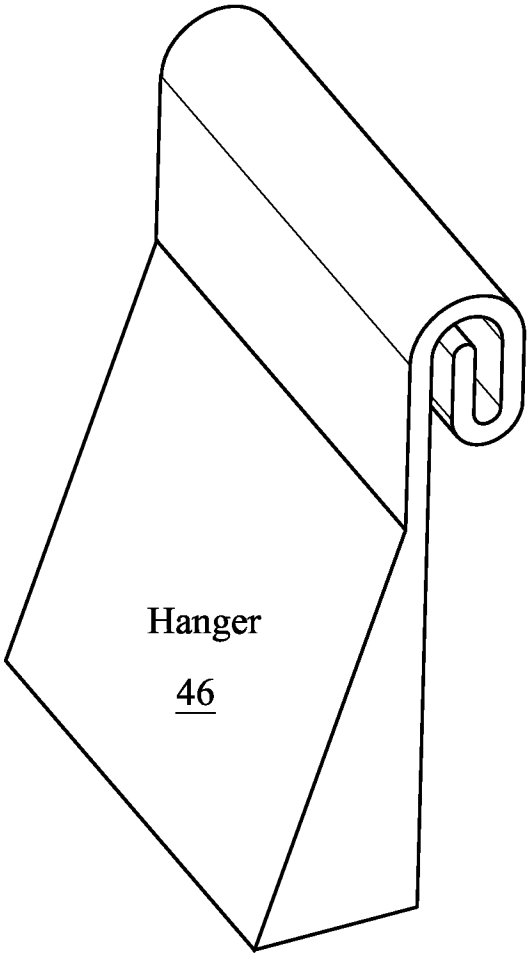
FIG. 3 is a side perspective view of a second embodiment of a sliding purlin hanger.
Figure 4:
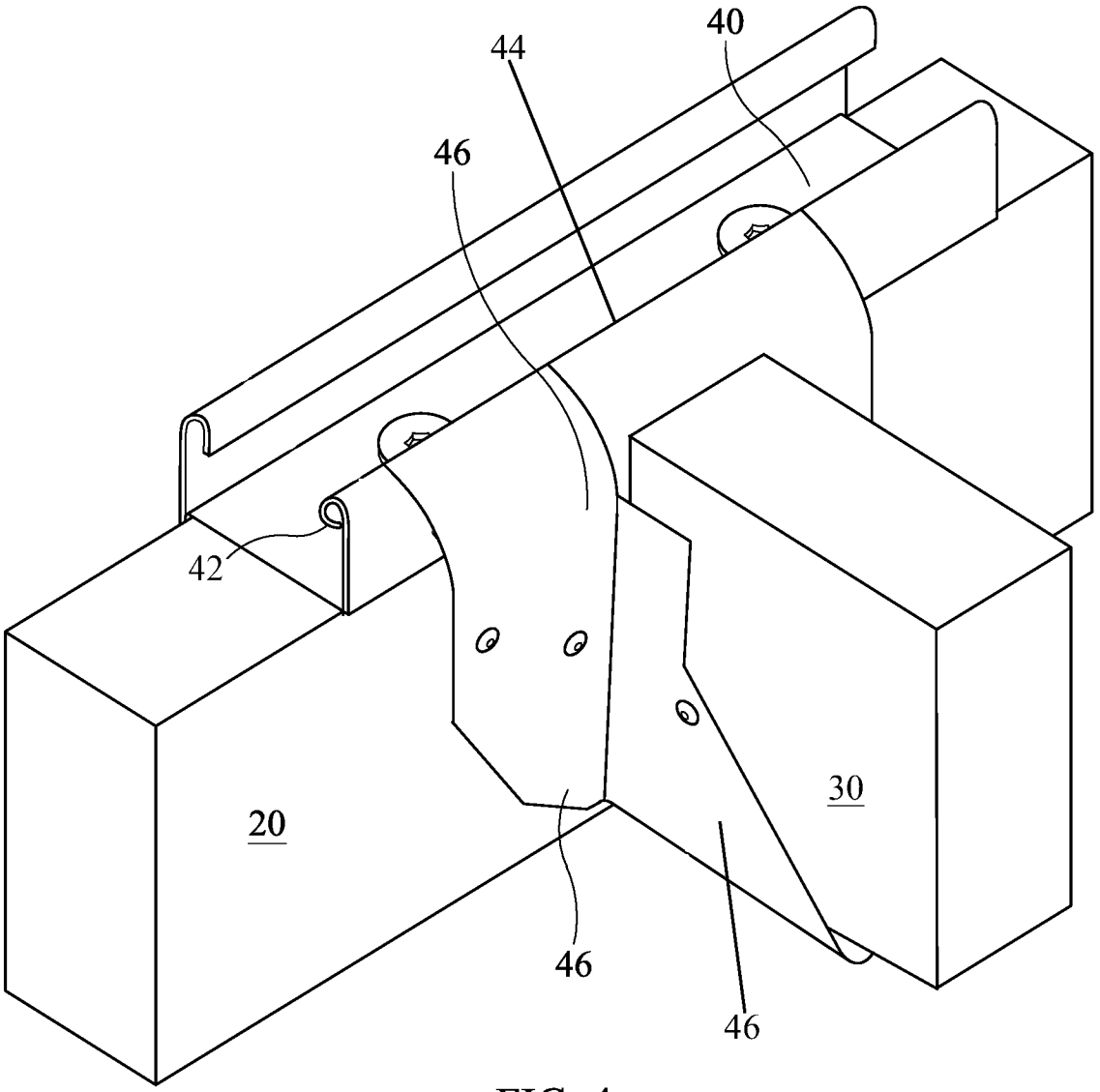
FIG. 4 is a perspective view of the second embodiment of the sliding purlin hanger of FIG. 3 mounted on a roof truss.

A second embodiment, generally shown in FIGS. 3, 4 and 7, utilizes a stationary hanger support bracket 40 mounted on a roof truss 20 with an open 180-degree stationary hem 42 at each side to slidably receive an open mating 360-degree sliding hem 44 from the hanger 46. (See FIGS. 7D, 7E and 7F.) The hanger 46 supports a sliding purlin 30. The hanger 46 is then free to travel the length of the 180-degree stationary hem 42. (Another version of this embodiment is to utilize a stationary hanger 46 support bracket mounted on a roof truss with an open laterally facing 360-degree stationary hem 44 at each side to slidably receive an open mating 180-degree sliding hem 42 from the hanger 46.) Stops of a type known in the art may be utilized to limit the travel of the hanger on the hanger support bracket.

Figure 6A:
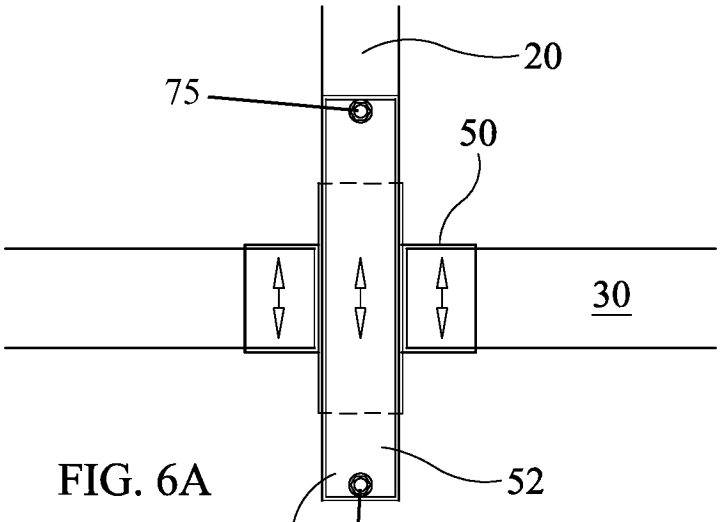
FIG. 6A is a top view of a third embodiment of a sliding purlin hanger with a top bar hold down with the hanger mounted on a truss, supporting a purlin on each side.
Figure 6B:
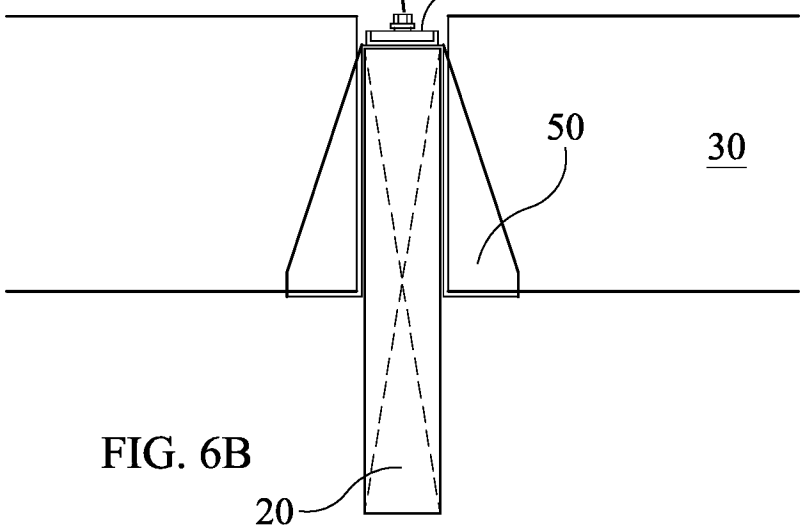
FIG. 6B is a front view of the third embodiment of a sliding purlin hanger with a top bar hold down with the hanger mounted on a truss, supporting a purlin on each side.
Figure 6C:
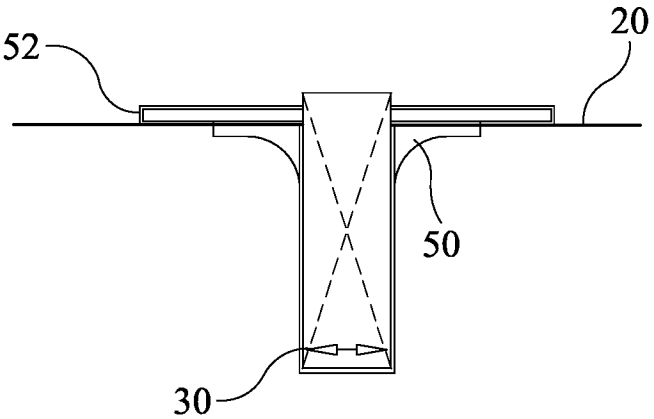
FIG. 6C is a side view of the third embodiment of a sliding purlin hanger with a top bar hold down with the hanger mounted on a truss, supporting a purlin on each side.
Figure 7B:
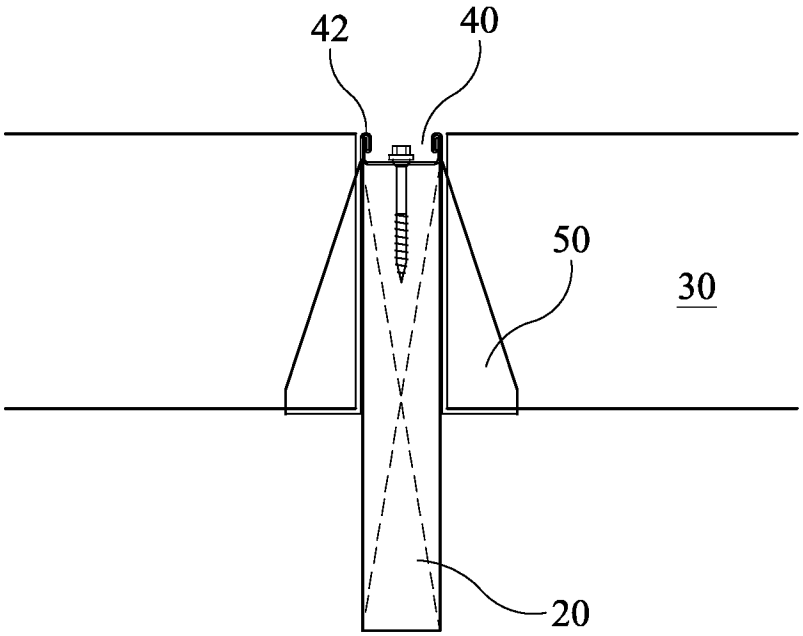
FIG. 7B is a front view of the second embodiment of a sliding purlin hanger utilizing nested hem tracks, with the hanger mounted on a truss, supporting a purlin on each side
Figure 7A:
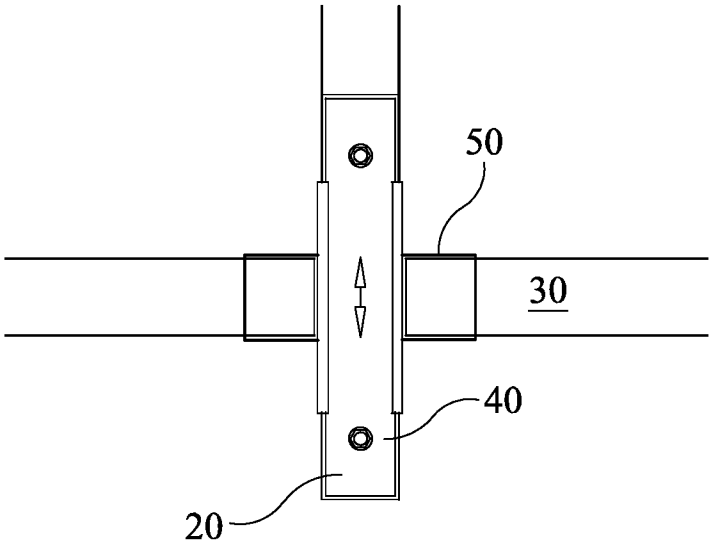
FIG. 7A is a top view of the second embodiment of a sliding purlin hanger utilizing nested hem tracks, with the hanger mounted on a truss, supporting a purlin on each side
Figure 7D:
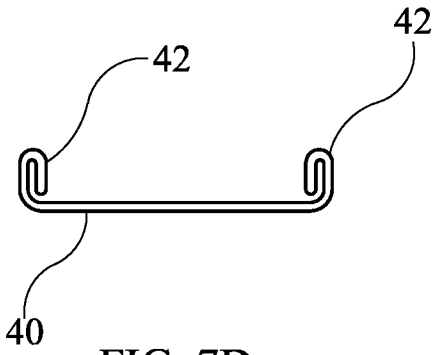
FIG. 7D is a side view of a stationary track used with the second embodiment of the present invention.
Figure 7F:
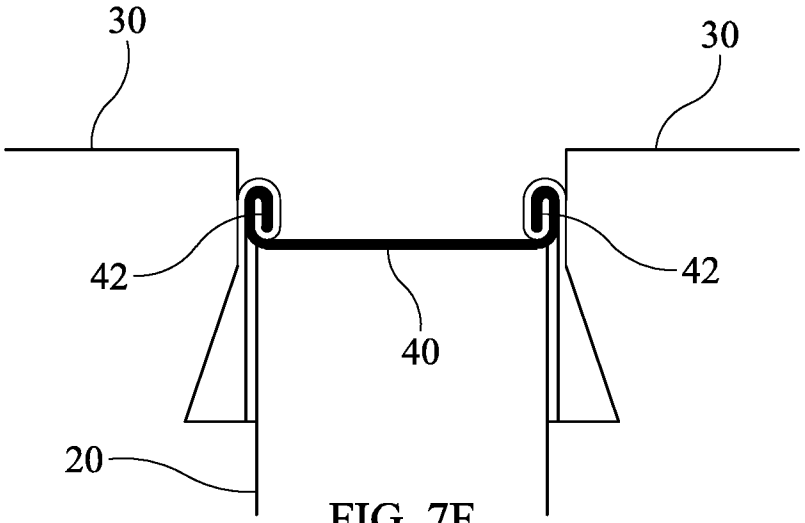
FIG. 7F is a side view of the top portion of a sliding purlin hanger mounted on the stationary track used with the second embodiment of the present invention.
Figure 7C:
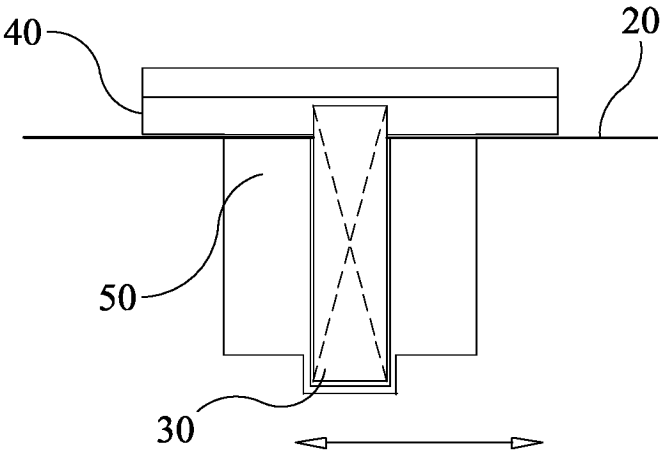
FIG. 7C is a side view of the second embodiment of a sliding purlin hanger utilizing nested hem tracks, with the hanger mounted on a truss, supporting a purlin on each side.
Figure 7E:
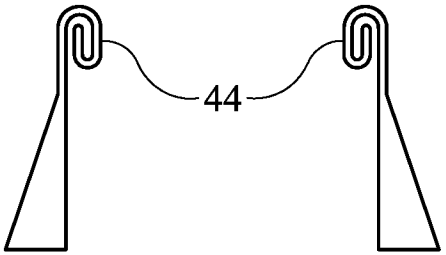
FIG. 7E is a side view of the top portion of a sliding purlin hanger used with the second embodiment of the present invention.

A third embodiment, generally shown in FIGS. 6A, 6B and 6C, discloses hanger 50 slidably mounted on truss 20. A hold down plate 52 is secured to the truss 20, spaced above the hanger 50, so that the hanger 50 can slide along the truss, under the hold down plate. The hanger travel is limited by the screws 75 securing the hold down plate 52 to truss 20 (as shown) or by other stops (not shown) added to or around the hold down plate or truss to limit travel of the hanger 50. This might include additional strategically placed screws, projections from the hold down plate or truss or other means known in the art.

Figure 8B:
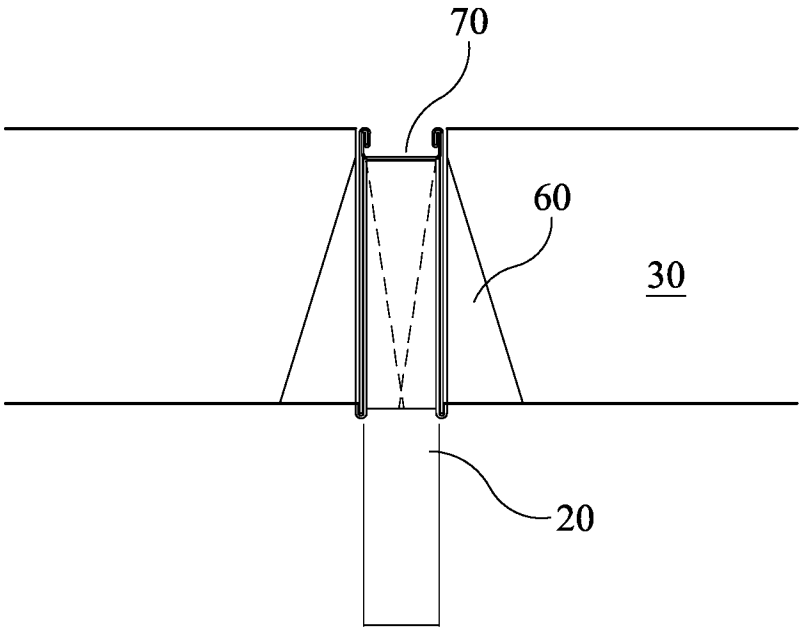
FIG. 8B is a front view of a sliding purlin hanger utilizing top and bottom hem tracks, with the hanger mounted on a truss, supporting a purlin on each side used with the fourth embodiment of the present invention.
Figure 8A:
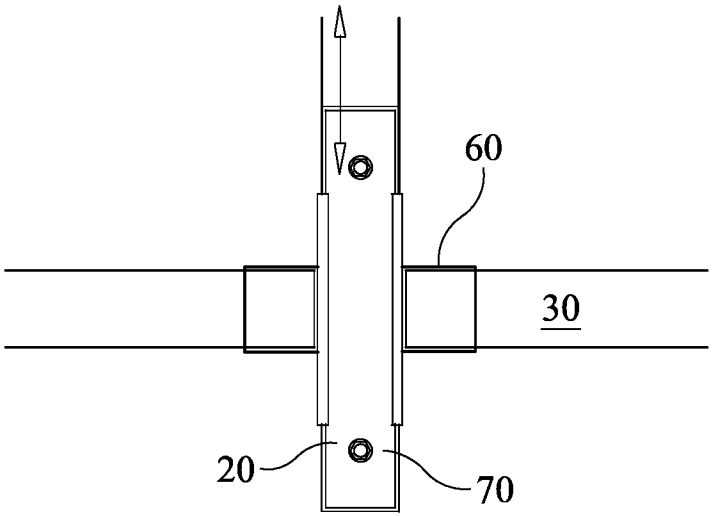
FIG. 8A is a top view of a sliding purlin hanger utilizing top and bottom hem tracks, with the hanger mounted on a truss, supporting a purlin on each side used with a fourth embodiment of the present invention.
Figure 8D:
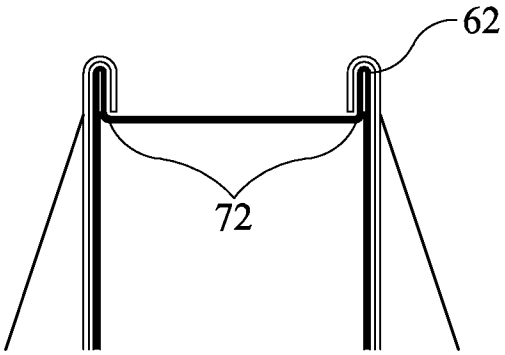
FIG. 8D is a side view of a portion of a sliding purlin hanger mounted on a top hem track used with the fourth embodiment of the present invention.
Figure 8C:
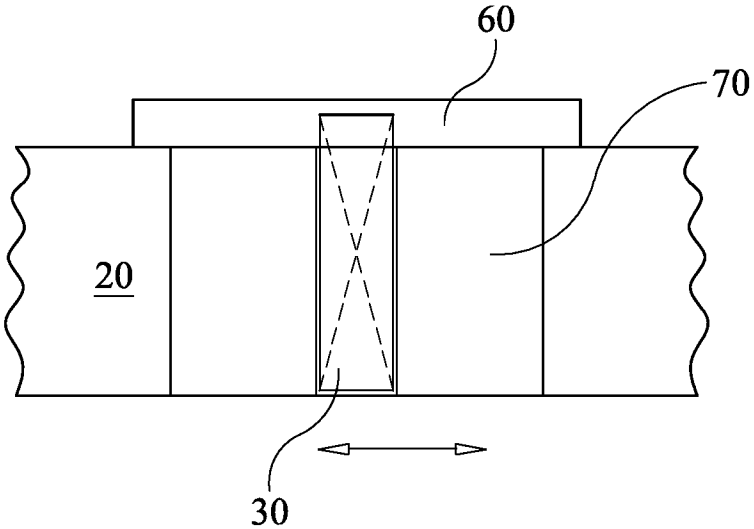
FIG. 8C is a side view of a sliding purlin hanger utilizing top and bottom hem tracks, with the hanger mounted on a truss, supporting a purlin on each side used with the fourth embodiment of the present invention.
Figure 8E:
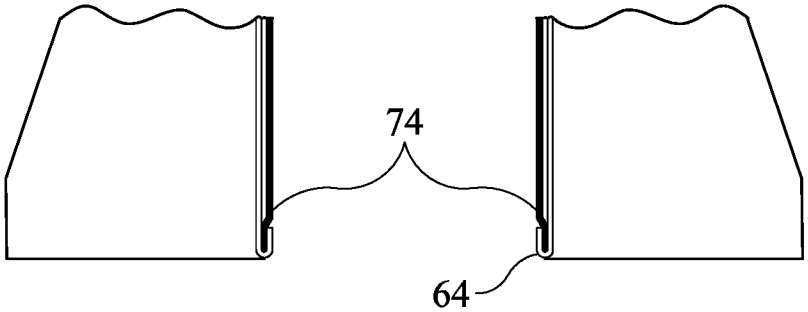
FIG. 8E is a side view of a portion of a sliding purlin hanger mounted on a bottom hem track used with the fourth embodiment of the present invention.

A fourth embodiment of the present invention is shown in FIGS. 8A, 8B, 8C, 8D and 8E. In this embodiment, hanger 60 slidably engages a stationary track 70 at both the top and bottom of the stationary track. As shown in FIG. 8D, stationary track 70 has an upper lip 72 that is received by a groove 62 defined at the top of hanger 60. Stationary track 70 also includes a lip 74 at its bottom that engages a groove 64 defined at the bottom of hanger 60. In this fashion, hanger 60 slidably engages the stationary track 70 at both the top and bottom of the hanger and stationary track. Stops of a type known in the art may be utilized to limit the travel of the hanger on the stationary track.

Figure 9:
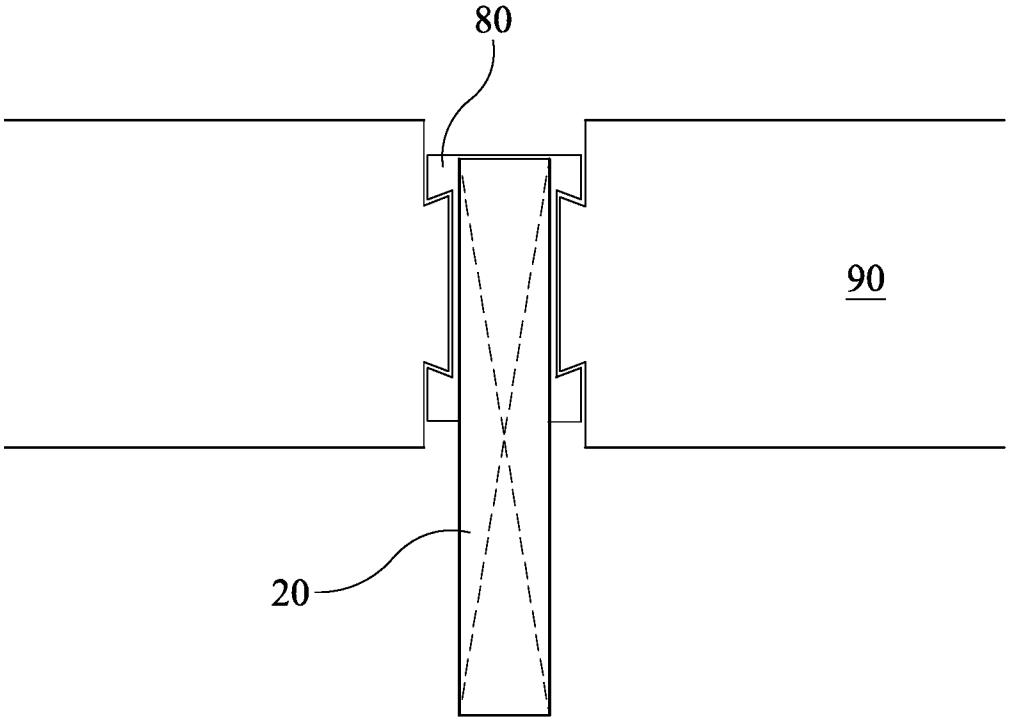
FIG. 9 is a side plan view of a fifth embodiment of the sliding purlin hanger utilizing dovetail slides mounted on a truss, supporting a purlin on each side.

A fifth embodiment of the present invention is shown in FIG. 9. In this embodiment, hanger 80 is secured to truss 20. On one or both sides of hanger 80 is a dovetail slide or track to slidably engage a dovetailed end of purlin 90. In this fashion, the purlins 90 are free to slide along the dovetailed tracks of the hanger 80. Again, stops of a type known in the art may be utilized to limit the travel of the purlin with respect to the hanger.

These embodiments described above reflect many arrangements of the present invention but should not be viewed as limiting. The present invention anticipates any embodiment that allows the purlins to be slidably mounted on the trusses, so that either or both of the trusses and purlins can move with respect to the other. The hanger can be slidably mounted to a truss support bracket on the truss or be fixed to it. Likewise, the support bracket can be slidably mounted to a truss or purlin or be fixed to it. The means for fixing the hanger to a truss or purlin are unlimited. Thus, there are limitless arrangements for utilizing the present invention to create sliding engagement between the trusses and purlins.

The effect of the present invention is that the cladding is allowed to freely move as it warms and cools. The device can be designed to accommodate the movement expected with very long panels. This eliminates the need for unsightly, expensive, and time-consuming thermal splices.

Construction of the components of the present invention from injected molded plastic and steel hybrids to maximize efficiency of movement of the cladding with respect to the roof trusses are also anticipated by the present invention.

In the preceding detailed description, reference is made to the accompanying drawings, which form a part hereof, and in which is shown by way of illustration specific embodiments in which the invention may be practiced. Because components of embodiments can be positioned in a number of different orientations, any directional terminology is used for purposes of illustration and is in no way limiting. It is to be understood that other embodiments are anticipated by the present invention and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to address particular circumstances. Various other modifications and changes will be apparent to those of ordinary skill.

The invention claimed is:

1. A roof mounting system for roof structures having at least one purlin having a first end supported on an elongated roof truss having a side surface, wherein the roof mounting system comprises:

a purlin hanger comprising:

a mounting bracket having an elongated slot of defined width for slidably engaging a truss, the elongated slot being aligned with the length of the truss on which the first member is mounted; and at least one purlin support secured to the mounting bracket in substantially perpendicular orientation to extend over a side surface of the truss, the purlin support including a back with a front surface, and two spaced sides and a bottom extending perpendicular from the back in a direction away from the front surface of the back, to define a purlin support that is open on the top and front for receiving the first end of a purlin; and a fastening mechanism having a head and a body, the body having a width less than the defined width of the mounting bracket slot and a head having a width greater than the defined width of the mounting bracket slot, such that the body of the fastening mechanism can engage the truss through the slot to slidably secure the mounting bracket to the truss.

2. The roof mounting system of claim 1, wherein the fastening mechanism comprises a screw that is fastened to the truss through the mounting bracket slot to retain the purlin hanger in sliding engagement with respect to the truss.

3. The roof mounting system of claim 2, wherein the fastening mechanism further comprises a first washer having a width that is larger than the slot width.

4. The roof mounting system of claim 3, wherein the fastening mechanism further comprises a second washer having a width that is smaller than the slot width.

5. The roof mounting system of claim 1, wherein the slot length limits a distance in which the purlin hanger is slidable with respect to the truss.

6. The roof mounting system of claim 1, wherein the slot is provided in a top of the mounting bracket.

7. The roof mounting system of claim 1, wherein the at least one purlin support comprises two purlin supports secured to opposite sides of the mounting bracket to extend down opposite facing sides of a truss.

8. The roof mounting system of claim 1, wherein the at least one purlin support mounted with respect to the mounting bracket supports a purlin in non-parallel relation to the truss.

9. A roof mounting system for roof structures having at least one purlin having a first end supported on a roof truss having a side surface, wherein the roof mounting system comprises:

a purlin hanger comprising:

a mounting bracket having an elongated slot of defined width for slidably engaging a truss, the elongated slot being aligned with the length of the truss on which the first member is mounted; and at least one purlin support secured to the mounting bracket in substantially perpendicular orientation to extend over the side surface of the truss, the purlin support including two spaced sides and a bottom extending in a direction perpendicular to and away from the side surface of the truss to define a purlin support that is open on the top and front for receiving a first end of a purlin; and a fastening mechanism having a head and a body, the body having a width less than the defined width of the mounting bracket slot and a head having a width greater than the defined width of the mounting bracket slot, such that the body of the fastening mechanism can engage the truss through the slot to slidably secure the mounting bracket to the truss.

* * * * *